US006814524B1

(12) United States Patent
Peterson

(10) Patent No.: US 6,814,524 B1
(45) Date of Patent: Nov. 9, 2004

(54) METHOD AND APPARATUS FOR LIFTING AND STABILIZING SUBSIDED SLABS, FLATWORK AND FOUNDATIONS OF BUILDINGS

(76) Inventor: James L. Peterson, 1601 SW. 35th Pl., Gainesville, FL (US) 32608

( * ) Notice: Subject to any disclaimer, the term of this patent is extended or adjusted under 35 U.S.C. 154(b) by 1 day.

(21) Appl. No.: 10/264,095

(22) Filed: Oct. 2, 2002

Related U.S. Application Data

(60) Provisional application No. 60/326,916, filed on Oct. 2, 2001.

(51) Int. Cl.[7] ..... E02D 35/00; E02D 27/48

(52) U.S. Cl. ..... 405/230; 405/229; 405/233; 52/125.1; 52/126.5

(58) Field of Search ..... 405/229, 230, 405/231, 232, 233; 52/125.1, 742.1, 742.14, 292, 293.3, 126.1, 126.5, 122.1; 254/29 R, 30

(56) References Cited

U.S. PATENT DOCUMENTS

| | | | |
|---|---|---|---|
| 3,096,076 | A | 7/1963 | Wälli |
| 3,796,055 | A | 3/1974 | Mahony |
| 3,902,326 | A | 9/1975 | Langenbach, Jr. |
| 4,246,974 | A | 1/1981 | Rothrock |
| 4,261,548 | A | 4/1981 | Kaderabek |
| 4,507,069 | A | 3/1985 | Murray et al. |
| 4,563,110 | A | 1/1986 | Langenbach, Jr. et al. |
| 4,591,466 | A | 5/1986 | Murray et al. |
| 4,673,315 | A | 6/1987 | Shaw et al. |
| 4,695,203 | A | 9/1987 | Gregory |
| 4,708,528 | A | 11/1987 | Rippe |
| 4,765,777 | A | 8/1988 | Gregory |
| 4,787,779 | A | 11/1988 | Clark |
| 4,800,700 | A | 1/1989 | May |
| 4,906,140 | A | 3/1990 | Clark |
| 4,911,580 | A | 3/1990 | Gregory et al. |
| 4,925,345 | A | 5/1990 | McCown, Jr. et al. |
| 4,962,913 | A | 10/1990 | Stewart |
| 4,997,314 | A | 3/1991 | Hartman |
| 5,006,015 | A | 4/1991 | Stephens et al. |
| 5,116,355 | A | 5/1992 | Freeman, III |
| 5,120,163 | A | 6/1992 | Holdeman et al. |
| 5,135,335 | A | 8/1992 | Stephens et al. |
| 5,154,539 | A | 10/1992 | McCown, Sr. et al. |
| 5,171,107 | A | 12/1992 | Hamilton et al. |
| 5,205,673 | A | 4/1993 | Bolin et al. |
| 5,213,448 | A | 5/1993 | Seider et al. |
| 5,217,325 | A | 6/1993 | Freeman, III |
| 5,234,287 | A | 8/1993 | Rippe, Jr. |

(List continued on next page.)

FOREIGN PATENT DOCUMENTS

GB 1418164 * 12/1975

OTHER PUBLICATIONS

Chance Underpinning Anchoring Report: A Case History (1996) pp. 17–18.

Atlas Slab Piers, Atlas Systems, Inc. pp. 1–4, undated.

Steel Underpinning by Magnum Piering Rock Solid, Magnum Piering of North Florida, Inc. (1989) pp. 1–3.

*Primary Examiner*—Jong-Suk (James) Lee
(74) *Attorney, Agent, or Firm*—Saliwanchik, Lloyd & Saliwanchik

(57) ABSTRACT

A method and apparatus for stabilizing and lifting subsided slabs, flatwork, foundations of buildings or other structures, and, in particular, to the slab pier and bracket which are used in the repair and support of said subsided slabs, flatwork, foundations of building or other structures. The apparatus is advantageous in situations where extra support is needed for raising the subsided slabs, flatwork, foundations or buildings or other structures. In a specific embodiment, the subject method and apparatus can include a bracket, top piece, and pier column. In this embodiment, the subject apparatus can use these components as the means for lifting the subsided slab.

32 Claims, 8 Drawing Sheets

U.S. PATENT DOCUMENTS 5,253,958 A 10/1993 Bellemare
5,257,879 A 11/1993 Veronelli
5,269,630 A * 12/1993 Bolin et al. ..... 405/229
5,336,021 A 8/1994 Freeman, III
5,433,556 A 7/1995 Freeman, III
5,492,437 A 2/1996 Ortiz
5,697,191 A 12/1997 MacKarvich
5,724,781 A 3/1998 Matthias et al.
5,775,847 A 7/1998 Carlinsky et al.
5,797,226 A 8/1998 MacKarvich
5,800,094 A 9/1998 Jones
5,951,206 A 9/1999 Gregory
5,983,573 A 11/1999 MacKarvich
6,079,905 A * 6/2000 Ruiz et al. ..... 405/235
6,142,710 A 11/2000 Holland, Jr. et al.
6,176,056 B1 1/2001 MacKarvich
6,503,024 B2 * 1/2003 Rupiper ..... 405/230
6,539,685 B2 * 4/2003 Bell et al. ..... 52/741.15

* cited by examiner

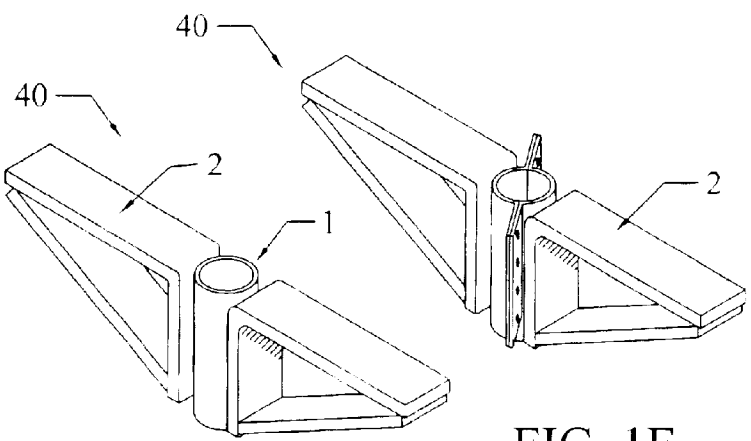
FIG. 1F
FIG. 1E
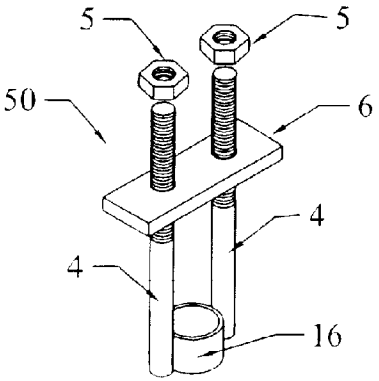
FIG. 1D
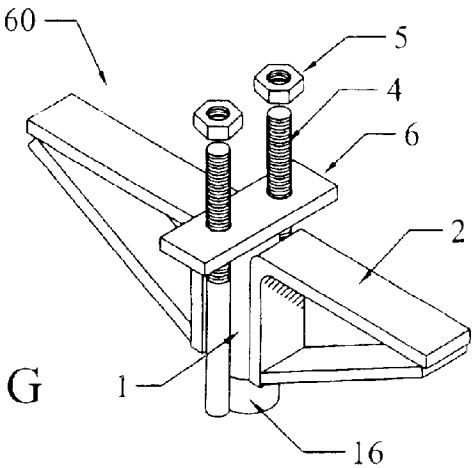
FIG. 1G

METHOD AND APPARATUS FOR LIFTING AND STABILIZING SUBSIDED SLABS, FLATWORK AND FOUNDATIONS OF BUILDINGS

CROSS-REFERENCE TO RELATED APPLICATION

This application claims the benefit of U.S. provisional application No. 60/326,916, filed on Oct. 2, 2001.

BACKGROUND OF THE INVENTION

The subject invention relates generally to a method and apparatus for lifting and stabilizing of subsided slabs, flatwork and foundations of buildings. The subject invention also pertains to a bracket and a slap pier assembly which can be used in the repair and support of subsided slabs, flatwork, and/or foundations.

Structural damage to a home or building can occur when the foundation or flatwork has settled or shifted out of position. This settling or shifting of foundation or flatwork can be caused by, for example, shifting or weaknesses in unstable ground. Typically, repair of a subsided slab involves inserting pier column, such as a pipe or pole, into the ground until reaching a load bearing strata, e.g, stable bedrock, coupling a slab support structure to the pipe or pole, and lifting the subsided slab with the slab support structure. To begin, a hole is often drilled through the foundation or slab in order to insert the pipe and the slab support structure used in lifting and restoring the foundation. Various size holes can be drilled depending on the specific method and apparatus employed. The slab can be lifted by the slab support structure as the slab support structure is raised with respect to the pipe or pole, and the weight of the slab can then be supported by the pipe or pole via the slab support structure. These excavation sites can be refilled at the end of the procedure with, for example, grout. Insertion of the pipes and the lifting of the slab support structures can involve complicated hydraulic pumps and lifts, with many nuts and bolts.

Some prior methods utilize a plate as a slab support structure. Relying on a plate can create a point, or a limited area, of contact support. This can cause undo stress on the area of the slab in contact with the plate which can potentially damage the slab.

Accordingly, there is a need for a method and apparatus for creating a larger area of contact between a slab support structure and a slab, flatwork, and/or foundation.

SUMMARY OF THE INVENTION

The subject invention pertains to a method and apparatus for lifting and stabilizing subsided slabs, flatwork, and/or foundations of buildings or other structures. The subject invention also relates to a bracket and a slab pier apparatus which can be used in the repair and support of subsided slabs. A specific embodiment of the subject method involves a bracket having one or more angles and corresponding brace pieces which form triangular sections, which can attach to a pier column, such as a pipe or pole, and provide a three dimensional structure for supporting a slab. The pier column can have a variety of cross-sectional shapes, such as square, circular or oval. The bracket is not limited to a triangular shape. Other shapes for the subject bracket can also be implemented, e.g., a rectangle, square, or curved shape, can also be utilized. A separate top piece can rest on the pier column and provide support to raise the bracket. In a specific embodiment, this top piece can provide support to raise the bracket by the use of one or more threaded rod and nut assemblies. The subject invention can utilize optional rebar or other appropriate material connected to the bracket, in situations where greater support of the subsided slab is needed. The subject invention provides a method for supporting a subsided slab using a small number of components and straightforward procedure.

The subject method and apparatus can be used to support the subsided slab over a large surface area. In a specific embodiment, concrete, grout, or other supporting material can be used to fill the excavated area so as to create a plug on which the slab can rest. The plug can envelop a portion, if not all, of the subject bracket. By enveloping the bracket, and or any other reinforcement structure attached to the bracket, the resulting plug, or reinforced pile cap can have increased tensile strength as compared with concrete, grout, or other supporting material without such reinforcing bracket or other reinforcing structure. Such a reinforced plug can act to distribute the force applied to support the slab to a broader area of the slab. Accordingly, the bracket, and any other structure attached to the bracket can provide strength to the plug. Rebar attached to the bracket can also provide additional strength to the plug.

BRIEF DESCRIPTION OF THE DRAWINGS

FIG. 1D illustrates the lifting assembly of an alternative embodiment of the subject invention.

FIGS. 1E and 1F show two examples of brackets that can be used with the lifting device of FIG. 1D.

FIG. 1G illustrates the combined bracket body and lifting device of FIG. 1D and FIG. 1E.

DETAILED DISCLOSURE OF THE INVENTION

Figure 1A:
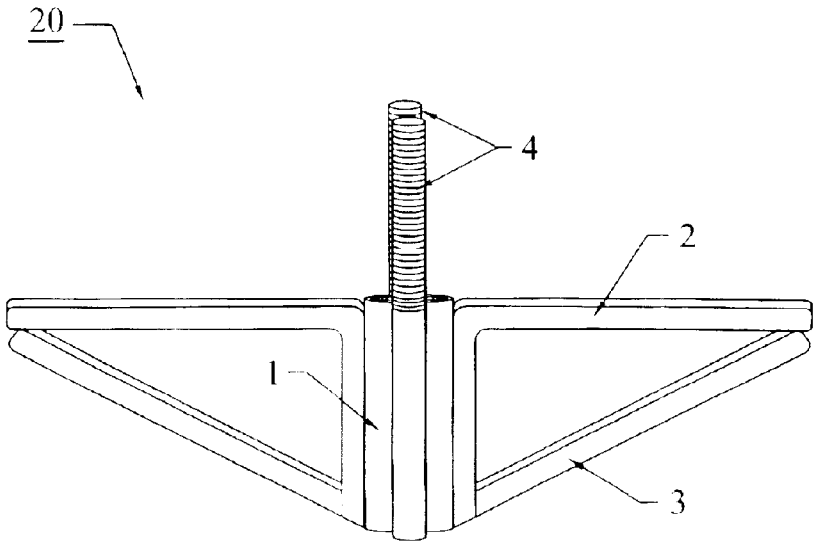
FIG. 1A shows a side view of a specific embodiment of a bracket in accordance with the present invention.
Figure 2:
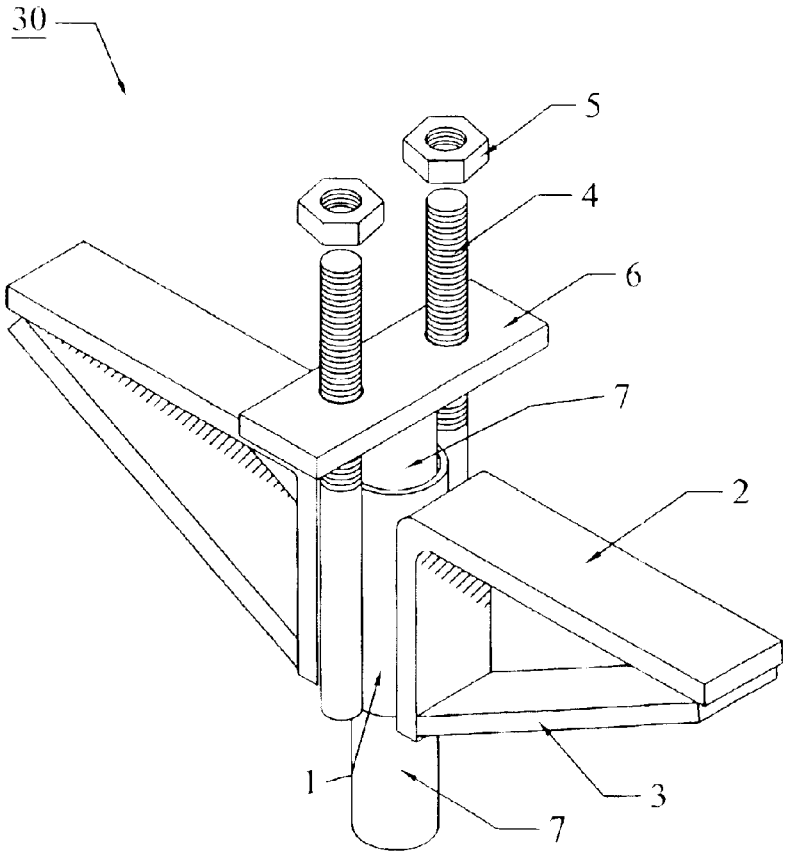
FIG. 2 shows a perspective view of a specific embodiment of the present invention.

The subject invention pertains to a method and apparatus for lifting and stabilizing subsided slabs, flatwork, and/or foundations of buildings or other structures. The subject invention also relates to a slab pier assembly 30 and bracket apparatus 20 which can be used in the repair and support of slabs. For the purposes of this patent application, such slabs, flatworks, foundations of buildings and/or other items to be lifted and stabilized can generally be referred to as slabs. The subject invention can produce a three dimensional plug 13 to support, for example, a subsided slab 9. FIG. 1 illustrates an embodiment of a bracket apparatus 20 in accordance with the subject invention. The subject bracket 20 can have tubing 1 to which at least one arm 2 can be fixedly attached. In a specific embodiment each arm can be part of an angle piece of material attached to tubing and each angle can have an arm which extends from tubing 1 and can be positioned under the slab to hold the slab. Preferably, two angles 2 are fixedly attached on opposite sides of tubing 1. Other embodiments may include additional angles 2 attached to the tubing 1. Although the description of the subject invention is based on an embodiment incorporating angles, arms 2 need not be part of an angle piece. A brace piece 3 can be fixedly attached to each angle 2 to create a three-dimensional structure which can be enveloped, partially or completely, by concrete, grout, or other supporting material. In the embodiments shown in FIGS. 1A, 1B and 1G, the brace piece 3 is welded to angle 2. Additional embodiments may include other methods of fixed attachment, such as bolts, clamps, or any other type of attachment means. At least one, and preferably at least a pair of threaded bolts 4, can be attached to the side of tubing 1. Again, in the embodiment shown in FIG. 1, threaded bolts 4 are welded to tubing 1. In the embodiment shown in FIG. 1, two threaded bolts 4 are attached to opposite sides of the tubing 1. The shape formed by each angle 2 and the corresponding brace piece 3 can take on varying forms from a triangle, as shown in FIGS. 1 and 2, to rectangles or curved forms. In a specific embodiment, the frame foxed by angle 2 and brace piece 3 can be one integral piece.

Figure 3:
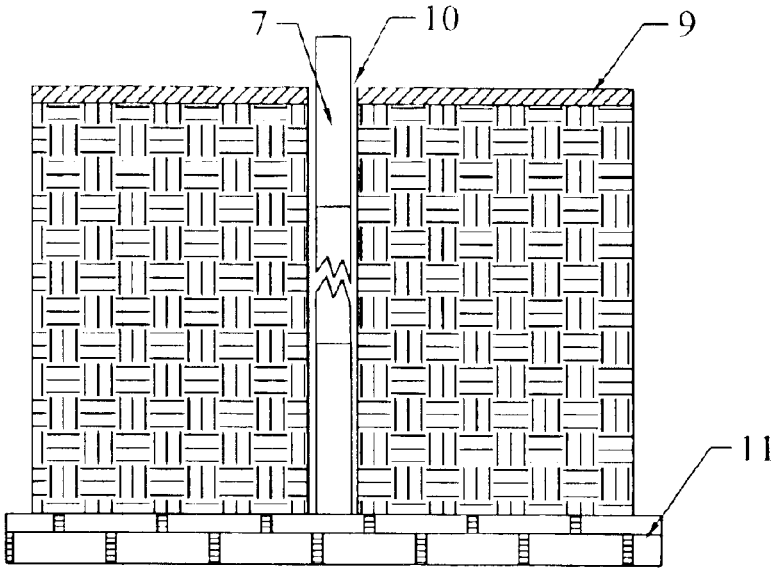
FIG. 3 shows a typical side view of a pipe extended to load bearing strata.

The bracket 20 shown in FIG. 1 can be positioned over the top of a pier column 7, as shown in FIG. 2. The base pier column 7 can provide a basis to hold the weight of a slab resting on the bracket 20. FIG. 3 illustrates a pier column 7 which has been inserted through an opening 10 in a slab 9 and driven into the ground until a load bearing strata or solid bedrock 11 is reached. This strata or bedrock 11 can provide support for the pier column 7 to support the weight of a slab 9. The pier column 7 can be formed from solid or hollow pipe sections having a circular, square, or other cross-sectional shape. Tubing 1 of bracket 20 is sized to fit over pier column 7 and is sized to allow pier column 7 to be inserted there through, and is shaped to prevent disengagement from pier column 7 when horizontal or rotational forces are applied to the tubing 1 with respect to the pier column 7 over which it is placed. Accordingly, tubing 1 can be continuous cylindrically around the tubing 1 body or could, for example, have a slit or slot down the side of the tubing 1 creating a discontinuity cylindrically around the body of tubing 1.

Referring to FIG. 2, the embodiment of the subject invention shown in FIG. 1 is shown in position on top of a pier column 7 with a top piece 6 also put in position. This slab pier assembly 30 provides a means to lift the bracket with respect to the top of pier column 7. More specifically, base pier column 7 has been inserted through and positioned within tubing 1 whereby the pier column 7 can provide support to allow the subject bracket 20 to lift, for example, a slab. Once tubing 1 is positioned with respect to base pier column 7, top piece 6 can be positioned such that the threaded rods 4 protrude above the top piece through openings in the top piece 6 and can rest on top of base pier column 7. In a preferred embodiment, top piece 6 has openings which correspond to the position of the threaded rods, through which the threaded rods are inserted to protrude above the pier column. Nuts 5 can be threaded onto threaded rods 4 as a part of the slab pier assembly 30. As the nuts 5 are further threaded down the threaded rods 4, the bracket 20 can be lifted with respect to the top of pier column 7. As the bracket 20 is lifted the slab 9 that is supported by the bracket will also be lifted. The pier column, 7 can support the top piece 6 such that the weight of the slab is supported by a top piece 6 utilizing one or more nuts 5 near the top of the pier column 7. In this way, the top piece 6 is less likely to bend or give way due to the weight of the slab. The top piece 6 can have a variety of shapes and comprise a variety of materials. The top piece 6 can have holes, slits, or cut-out sections which allow protrusion of the threaded rods 4 above the top piece 6.

Figure 6:
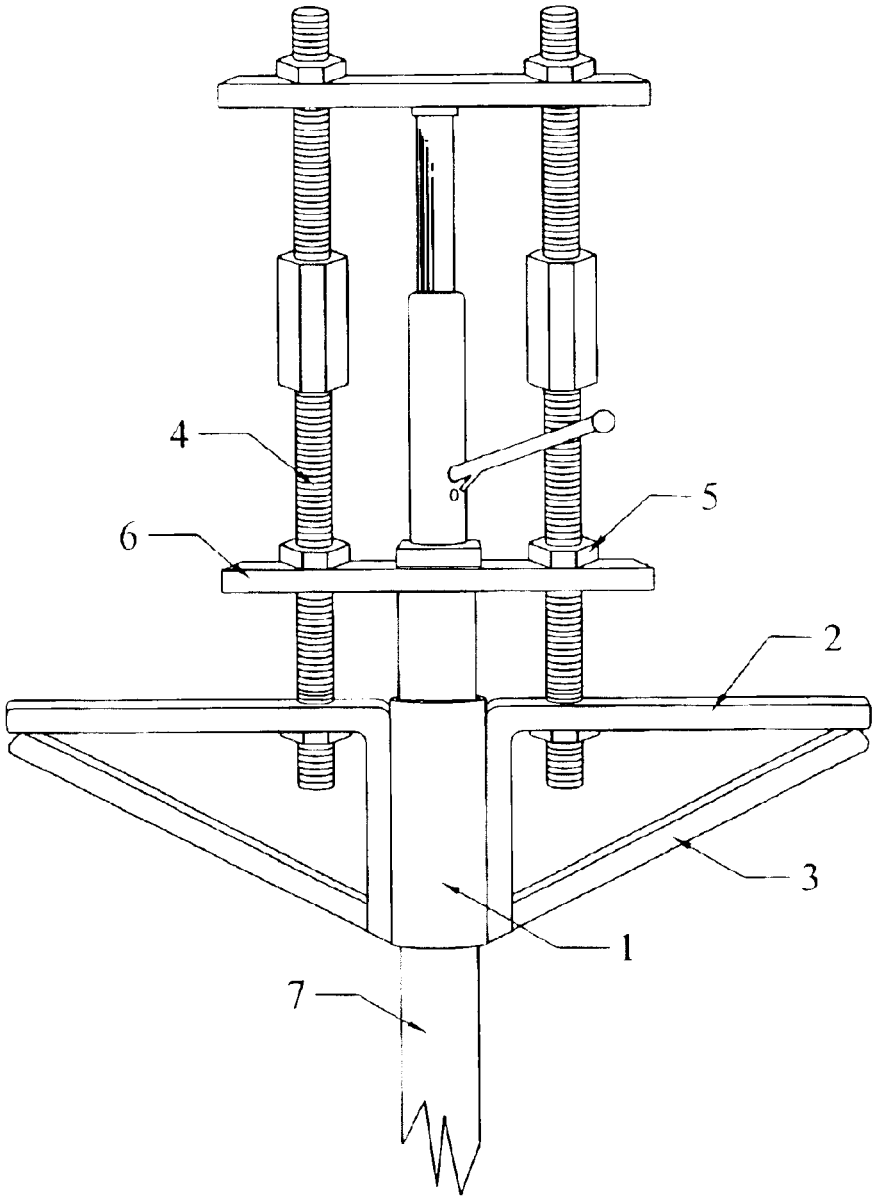
FIG. 6 illustrates a specific embodiment of the subject invention which utilizes a hydraulic jack to raise the bracket with respect to the pier column.

FIG. 6 illustrates another means for raising the subject bracket with respect to the pier column 7 without using the threading of the nuts to raise the bracket. The embodiment shown in FIG. 6 utilizes a hydraulic jack to raise a plate connected to the threaded bolts attached to the bracket with a double threaded nut and extension bolts. After the jack raises the bracket, the nuts can be tightened down to hold the bracket in place. The embodiment of FIG. 6 illustrates how the threaded bolts can be attached to the bracket in a variety of manners known in the art.

Figure 5:
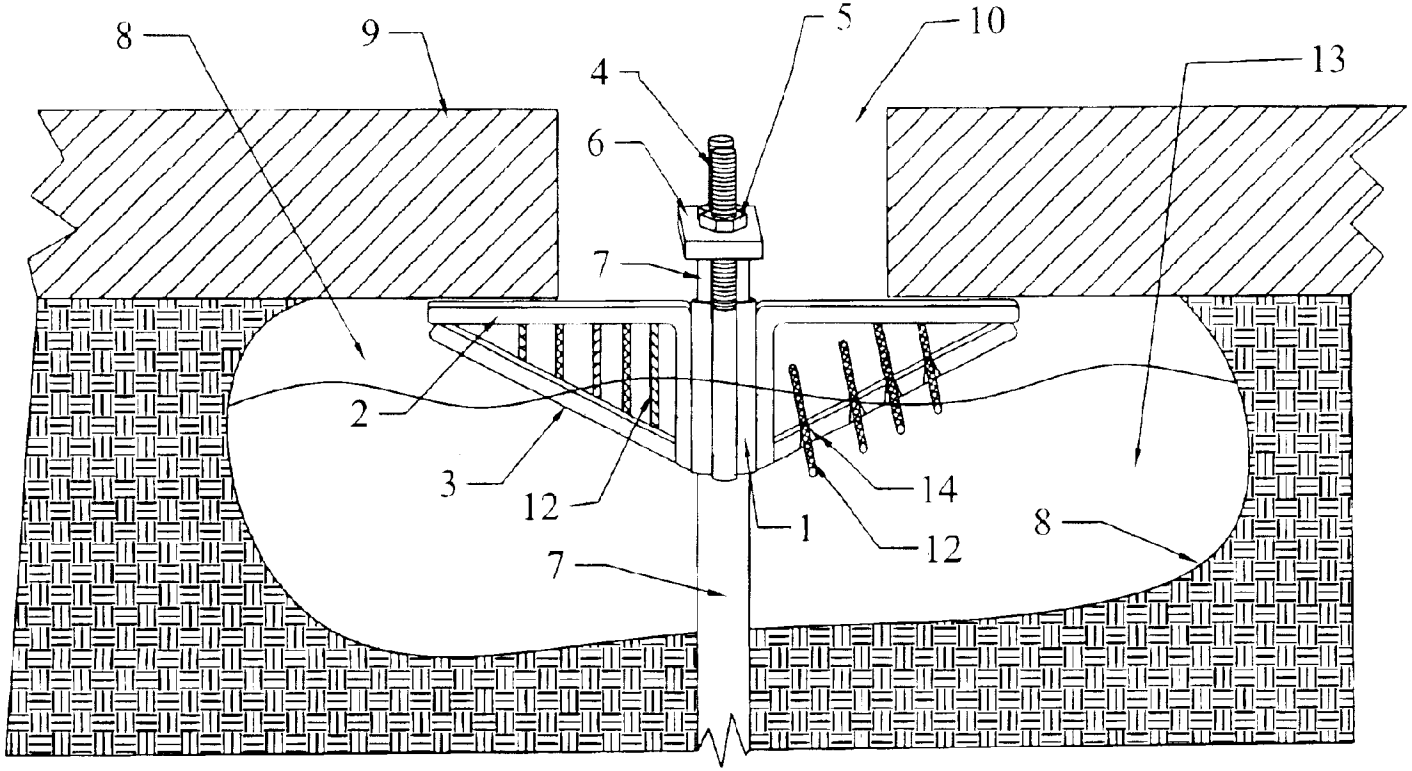
FIG. 5 shows a side view of a specific embodiment of the present invention in use to lift a slab.

In a specific embodiment, rebar 12, or some other reinforcement material, can be placed and positioned with wire 14 or other means to the angles 2 and/or brace piece 3 of the subject bracket 20. The rebar 12 can be held in place, e.g., tack welded or wired 14, after putting the bracket through opening 10, or before putting the bracket 20 through opening 10 if the opening 10 is large enough to receive the bracket 20 with the rebar 12 or other reinforcement material in place. For illustration purposes, the rebar 12 on the right side of the bracket 20 in FIG. 5 is shown approximately horizontally perpendicular to brace piece 3, while the rebar 12 on the left side of the bracket 20 in FIG. 5 is shown attached vertically to the brace piece 3 and the angle 2. Of course, rebar 12 can be positioned in one or both of these orientations, as well as at other angles as desired. Concrete, grout, or other supporting material 17 can then be used to fill the excavated region 13 filling the volume around the angles 2, brace pieces 3, rebar 12, and exposed base pier column 7 to create a pile cap, or plug 13. The rebar 12 attached to the bracket 20 can provide reinforcement and additional strength for the pile cap or plug 13.

Figure 7A:
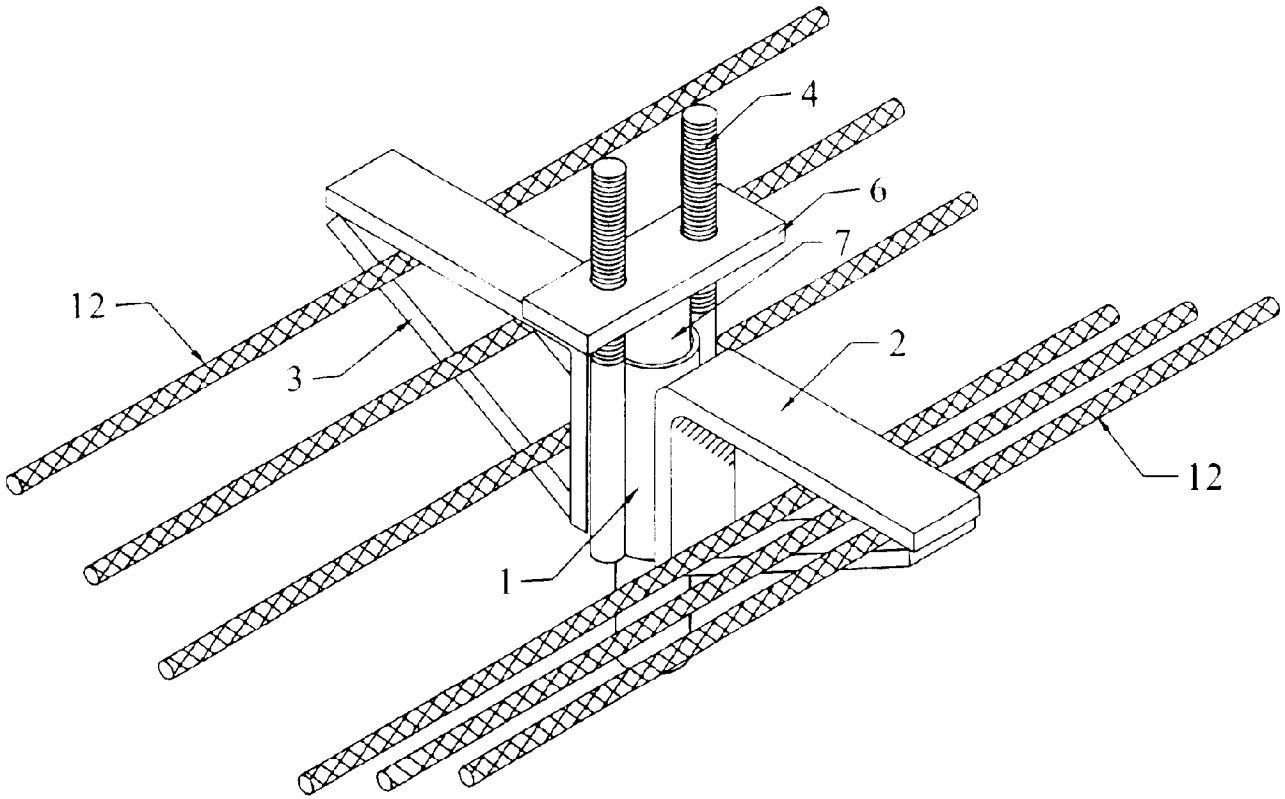
FIGS. 7A and 7B show a specific embodiment of a bracket in accordance with the subject invention with rebar attached to the bracket and the same bracket with attached rebar as installed under a slab, respectively.
Figure 7B:
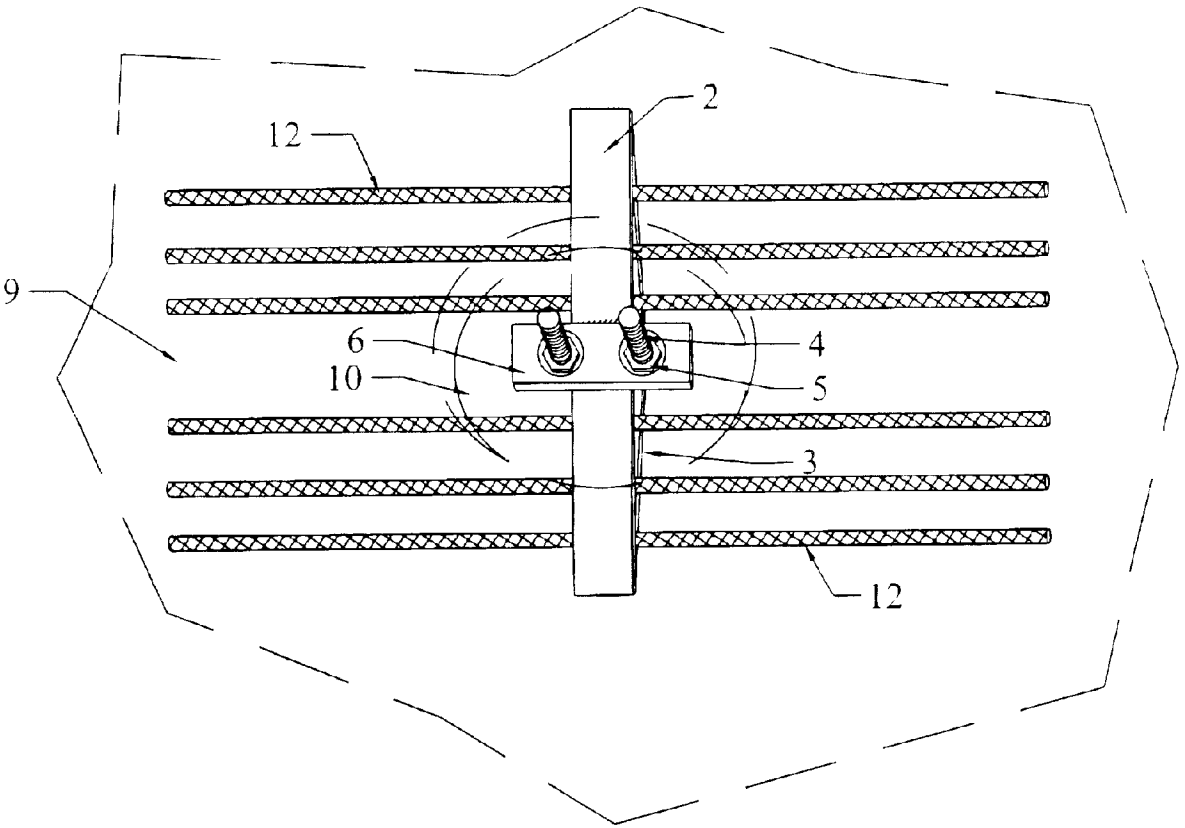

FIG. 7A shows a specific embodiment of the subject bracket with rebar welded to it. FIG. 7B shows how this bracket can be positioned in the excavated region under. Once the concrete, or other material is introduced into the excavated region and hardens around the bracket and rebar, a plug, or reinforced pile cap, is formed with high tensile strength. This plug then distributes the force of supporting the slab to a larger area of the slab, and can distribute the force uniformly around the opening in the slab.

Figure 1C:
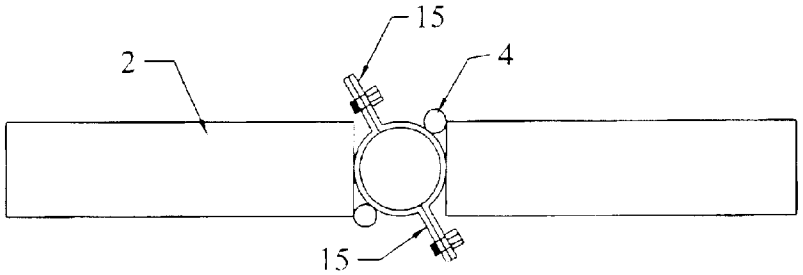
FIGS. 1B and 1C show an alternative embodiment of the bracket, wherein the bracket comprises of two pieces which can be joined to form a complete bracket.
Figure 1B:
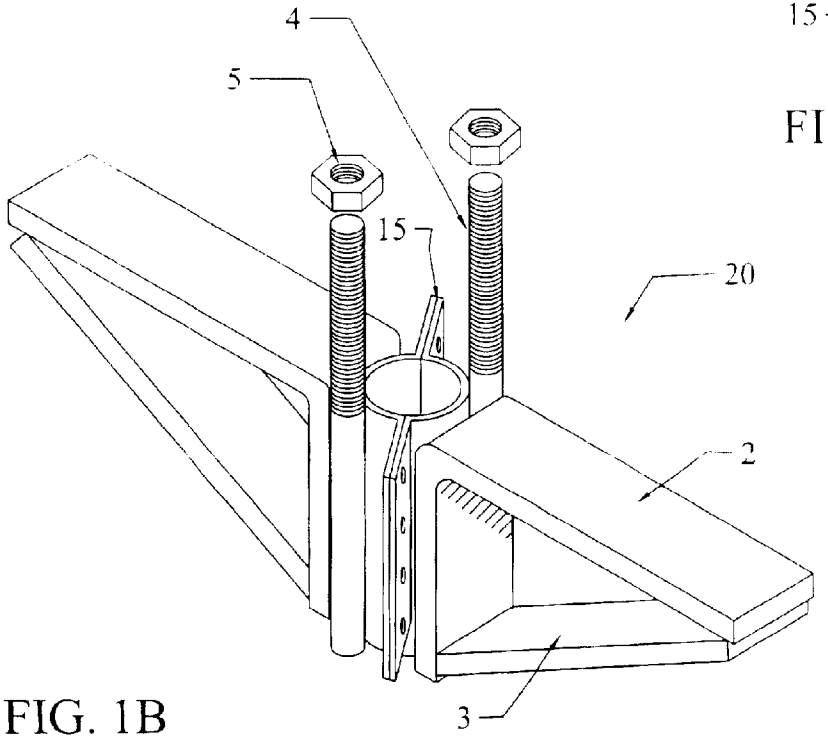

A further embodiment of the bracket 20 is shown in FIG. 1B and FIG. 1C. In this embodiment, the bracket 20 can comprise a plurality of sections which can be connected together to form the bracket. These sections can be modified, for example with one or more flanges 15, such that the sections of the bracket 20 can be connected together to form the bracket. These sections can be connected together after they are inserted into the excavated area under a slab 9 so that the assembled bracket is positioned with base pier column 7 passing there through. FIG. 1B and FIG. 1C illustrate an embodiment wherein the bracket 20 is divided through the tubing 1 into two sections and modified with flanges 15 protruding from either edge of the tubing 1 to provide a means for connection of the pieces of the bracket 20 together using, for example, nuts and bolts or welding. Other means known in the art can also be used to connect the sections of bracket 20 together. Dividing the bracket into smaller sections allows the use of a smaller opening 10 in the slab for insertion of the sections of bracket 20 into the excavated area under the slab 9.

Figure 4:
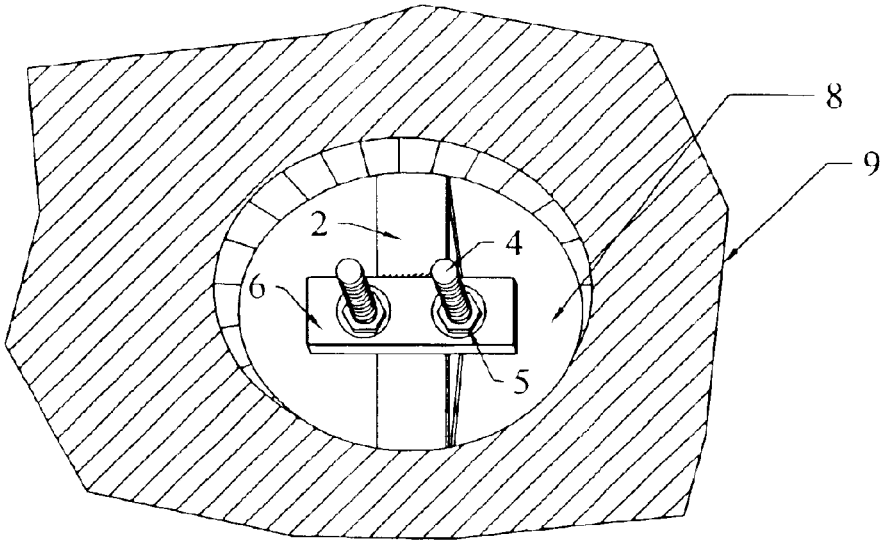
FIG. 4 illustrates a top view of an embodiment of the subject invention in use to raise a slab.

A preferred method of installing the bracket 20 to create the slab pier assembly 30 of the subject invention is now discussed, and illustrated in FIGS. 3, 4, and 5. An opening 10 can be created through the slab 9. A drive assembly can then be mounted to the slab 9 to drive a pipe, or base pier column, 7 into the ground. For example, a hydraulic drive assembly can be used with three or more 5,000 lb wedge anchors in order to drive the base pier column into the ground. In a specific embodiment, the base pier column 7 can be extended to the bedrock by putting 3 ft×1 inch diameter galvanized schedule 40 pipes into the ground in sections with interlocking male/female connections. The sections of base pier column 7 can be stacked until the base pier column extends to bedrock 11 until reaching a position so as to provide a desired amount of support. The extended base pier column can then be load tested to ensure proper support. The drive assembly and the last section of the pier column can be removed. In a specific embodiment, the removed section of pier column can be sized to a length such that, once connected again to the base pier column resting on the bedrock, with the bracket 20 positioned over the pier column 7, the top piece 6 can be placed over the threaded rods 4 and can rest on top of the pier column without extending past the top of opening 10 in the slab. In a specific embodiment, the base pier column is cut such that the top piece 6 does not extend within 2 inches from the top of the slab 9. With respect to an embodiment comprising a bracket having a plurality of pieces, for example, as shown in FIGS. 1B and 1G, the last section of the base pier column need not be removed in order to position the bracket.

A larger opening 10 can then be created in the slab 9 and centered about the original opening 10. Alternatively, the original opening can be sized such that the opening need not be enlarged. The soil below the enlarged opening 10, and to the sides of the opening 10 under the slab, can be excavated to allow room for the subject bracket 20 to be inserted below the slab. In a specific embodiment, the soil can be excavated to approximately 12 inches below the slab and several inches to the sides. Preferably, the size of the larger opening cut in slab should be kept as small as possible to retain as much of the strength of the slab as possible, while being large enough to allow the subject bracket 20 to be inserted through the opening 10 and into the excavated area 8. Accordingly, in a preferred embodiment, brace piece 3 forms a triangular shape with angle 2 to create an overall bracket 20 shape which allows the insertion of one end of the bracket through the opening 20 and far enough into the excavated area 8 to allow the other end of the bracket 20 to also move past the side of the slab opening 10 and into the excavated area 8. Each end of the bracket 20 can then be brought into contact with the bottom surface of the slab to support the slab's weight.

In a preferred embodiment, rebar or other appropriate material 12 can be connected or attached to the bracket 20 after insertion of the bracket into the excavated area 8. Attaching the rebar 12 to the bracket 20 after insertion of the bracket into the excavated area 8 allows the use of rebar 12 lengths which, if connected or attached before insertion of the bracket 20 through the opening, would not allow for the bracket 20 with the rebar 12 to be inserted through the opening in the slab 10 and into the excavated area.

After positioning the bracket 20 in the excavated area 8, the sized section of base pier column can be inserted through the tubing 1 on bracket 20 and connected to the existing base pier column below the slab. The top piece 6 of the subject bracket 20 can be placed onto the threaded rods 4, and the nut assembly 5 can be screwed down to create contact between the top piece 6 and base pier column 7. In a preferred embodiment, at least two threaded rods are attached to tubing 1. Nuts 5 can be tightened, preferably simultaneously, to raise the bracket 20 toward top piece 6. This in turn can draw the subject bracket 20 upward with respect to the base pier column 7 and thereby raise the slab 9 to the desired elevation.

With respect to the embodiment comprising a bracket having a plurality of pieces, for example as shown in FIGS. 1B and 1C, a smaller final opening in the slab can be used as each piece is easier to get through the opening.

Another embodiment of the subject invention is shown in FIGS. 1D through 1G. This embodiment comprises a bracket body 40 and a lifting device 50. The bracket body 40, shown in FIG. 1E can include tubing 1. FIGS. 1E and 1F illustrate circular tubing, but other shapes of tubing, e.g. square, oval, rectangular, etc., may be used as well depending on the cross-sectional shape of the base pier column with which the bracket is to be used. The bracket body can also include at least one angle 2 which may be attached to the tubing 1. In a preferred embodiment, two angles are attached on opposite sides of the tubing. The angle 2 may also include a brace piece 3. As illustrated in FIG. 1F and mentioned previously, the bracket body 40 can be divided into two or more pieces which can be connected together before use. Dividing the bracket body 40 into a plurality of connectable pieces can allow the use of a smaller opening 10 in the slab. The bracket body 40 can also be modified, for example with flanges or tabs, to aid in the assembly of the bracket body 40. The bracket body can be assembled by welding, or soldering, or with the use of bolts or bands or any other method known in the art. In a specific embodiment, the bracket body 40 is divided through the tubing into two or more pieces and flanges are added to the edges of the tubing. In a specific embodiment, the flanges can have holes along the length of the flange whereby nuts and bolts, or perhaps rivets, may be used to assemble the bracket sections. The divided bracket body 40 can be assembled within the excavated area and preferably assembled around the base pier column 7 such that the top section of the base pier column 7 does not have to be removed to position the bracket with respect to the base pier column.

FIG. 1D is an illustration of a lifting device 50 which can be used in conjunction with the bracket body 40. The lifting device 50 can include a bracket stand 16 to which may be attached one or more threaded rods 4. The bracket stand can comprise a second tubing through which the base pier column 7 can be inserted. Preferably, the shape of the second tubing of the bracket stand 16 corresponds to the tubing 1 used on the bracket body 40. The tubing 1 used in the bracket body 40 and the lifting device 50 should allow the entire bracket body 40 and lifting device 50 once assembled to move freely along the length of the exposed base pier column 7. The top section of the base pier column can be sized such that, once the top section of the base pier column is in position, the top edge of the pier column is below the desired position of the top of the slab. The lifting device and bracket body 40 can be inserted through the opening in the slab and into the excavated area under the slab. The bracket body 40 can be inserted between the threaded rods 4 on the lifting device 50 so as to rest on the bracket stand 16. After a bracket body 40 is inserted onto the lifting device 50, the combined bracket body 40 and lifting device 50 are positioned in the excavated area to receive the upper section of base pier column 7. The upper section of base pier column 7, which has been previously removed and sized, is reattached to the bottom portion of the base pier column 7 by inserting it down through the tubing 7 on the bracket body 40 and the second tubing of the bracket stand 16. In a specific embodiment, not shown in the figures, the lifting device 50 can have two or more pieces with flanges much like the bracket shown in FIG. 1F. In this case, used with a bracket body, it may not be necessary to remove the top portion of the pier column 7. The pieces of the divided lifting device and bracket body may be inserted into the excavated area with the entire pier column 7 in place. The pieces of the divided bracket can then be assembled around the pier column 7.

After placement of the lifting device and bracket body into the cavity and placement of the upper portion of the base pier column 7 into place, a top plate 6, which can have holes for receiving threaded bolts 4, may be placed over the top of the base pier column such that the threaded rods 4 on the lifting device 50 protrude above the top piece 6. Nuts 5 may then be attached to the threaded rods and threaded further onto the threaded rods. Referring to FIG. 1G and FIG. 5, by continuing to thread the nuts 5 further onto the threaded rods, the top piece 6 remains in contact with the top of the pier column, while the bracket body 40 and lifting device 50 are raised up the base pier column 7 until the angles 2 on the bracket body 40 come into contact with the bottom of the slab 9. As the nuts 5 continue to be threaded further onto the threaded rods 4, the bracket body 40 and the lifting device 50 continue to be raised with respect to the pier column and the slab 9 which rests on the angles of the bracket body 40 can now also be raised to the desired height or angle. In a specific embodiment, the subject invention can incorporate means for connecting top piece 6 to the bracket other than threaded rods. For example, non-threaded rods can be used and pins can be put through the rod to prevent the rod from being pulled out of top piece 6. Other means known in the art could be used as well.

In a specific embodiment, referring to the embodiment shown in FIG. 1A, a 4" section of 2" outer diameter (OD)×0.28" wall (ASTM A513 types) tubing 1 can have two 6" long ¾" threaded rods 4 welded to opposite sides of the tubing 1. Two angles 2, ½" thick and 2" wide, can have a 4" section which can be welded to the tubing 1 and an 8" section extending out from the tubing. An about 8"–9" long 2" wide×½" thick brace piece 3 can be welded to the ends of the angles 2 (and tubing 1 if desired) to form a triangular form. A 6" long×2" wide×½" thick plate can be used as a top piece 6. In this embodiment, a 10" diameter opening 10 can be cored into the slab and soil removed from beneath the slab to about 12". As discussed, rebar 12 or other appropriate reinforcement material can be attached to brace piece 3, angles 2, and or other locations on bracket 10. Once nuts 5 are tightened such that the slab is at the desired elevation, four 12" long #5 rebar 12 can be placed and tied off or otherwise attached onto the brace pieces 3 of the subject bracket 20. Once the rebar 12 is attached, the excavated area 8 below the slab can then be filled with concrete to create a plug 13 or reinforced pile cap. In a specific embodiment, 3,000–5,000 psi concrete can be used. In an alternate embodiment, the nuts 5 can be tightened to different levels to create a desired angle and/or elevation for the slab 9.

It should be understood that the example and embodiments described herein are for illustrative purposes only and that various modifications or changes in light thereof will be suggested to persons skilled in the art and are to be included within the spirit and purview of this application and the scope of the appended claims.

What is claimed is:

1. A method for lifting and stabilizing a subsided slab, comprising:

positioning a base pier column to provide support sufficient for the weight of a slab to be lifted and stabilized;

creating an opening in the slab large enough to allow insertion of a bracket, wherein the bracket comprises: a tubing which can slidably receive through the tubing an end of a section of pier column; at least one threaded rod fixedly positioned relative to the tubing such that a threaded portion of the at least one threaded rod extends above a top end of the tubing; at least one arm fixedly positioned relative to the tubing such that a section of each arm protrudes from the tubing for supporting the slab, and a corresponding at least one brace plate having a first end fixedly attached to the protruding portion of the corresponding arm and a second end positioned proximate to a position on the tubing lower than the protruding portion of the corresponding angle so as to provide support of the protruding portion of the corresponding arm;

excavating material from below the opening and to the sides under the slab so as to create an excavated region large enough to accept the bracket and allow the positioning of the bracket such that at least a portion of the protruding portion of each of the at least one arm is under the slab;

inserting the bracket through the opening and positioning the bracket such that the at least a portion of the protruding portion of each of the at least one arm is under the slab;

positioning a top section of pier column such that the top section of pier column is supported by the base pier column and the top section of pier column is positioned within the tubing of the bracket with a top of the top section of pier column extending above a top of the tubing;

placing a top piece over the lop of the top section of pier column such that the at least one threaded rod passes through the top piece;

raising the bracket relative to the top piece, wherein as the bracket is raised relative to the top piece, the slab is raised relative to the base pier column;

introducing a material which hardens into the excavated region so as to at least partially envelope the bracket with the material, wherein when the material hardens the material, and the bracket, form a plug which supports the slab at the desired position.

2. The method according to claim 1, further comprising attaching at least one reinforcement member to the bracket prior to introducing the material which hardens into the excavated region, wherein after introducing the material which hardens into the excavated area and the material hardening, the at least one reinforcement member reinforces the plug.

3. The method according to claim 2, wherein the at least one reinforcement member comprises rebar.

4. The method according to claim 3, wherein the top section of pier column is approximately vertical, the slab is approximately horizontal, and wherein the at least one reinforcement member is attached to the brace plate in an approximately horizontal orientation.

5. The method according to claim 2, wherein the at least one reinforcement member extends under the slab.

6. The method according to claim 1, wherein positioning the base pier column comprises driving the base pier column into the ground until reaching bedrock or a similar load bearing strata.

7. The method according to claim 1, wherein positioning the base pier column comprises:

creating an initial opening in the slab large enough to allow insertion of a pier column section through the initial opening in the slab;

inserting sections of pier column coupled end to end, through the initial opening in the slab and driving the sections of pier column into the ground until bedrock or a similar load bearing strata is reached and at least one section of pier column extends past the top of the slab; and removing the at least one section of pier column which extends past the top of the slab.

8. The method according to claim 1, wherein the material which hardens is concrete.

9. The method according to claim 1, wherein prior to inserting the top section of pier column through the top end of the tubing of the bracket, further comprising cutting the top section of pier column to a length such that after the slab reaches the desired position the top piece is below the level of the top of the slab.

10. The method according to claim 1, wherein the threaded rod is fixedly positioned relative to the tubing by welding the at least one threaded rod to the tubing, wherein the arm is fixedly positioned relative to the tubing by welding the arm to the tubing and wherein the corresponding at least one brace plate is fixedly attached to the protruding portion of the corresponding arm and fixedly positioned proximate to a position on the tubing lower than the protruding portion of the corresponding angle by welding.

11. The method according claim 1, wherein the bracket has two threaded rods fixedly attached to the tubing.

12. The method according to claim 11, wherein the bracket has two arms fixedly attached to the opposite sides of the tubing.

13. The method according to claim 12, wherein inserting the bracket through the opening and positioning the bracket comprises: inserting the bracket through an opening in the slab large enough to allow insertion of the bracket through the opening; and, after insertion through the opening in the slab, positioning the bracket such that the distal end of each of the two arms are brought into contact with the bottom surface of the slab to support the slab.

14. The method according to claim 13, wherein raising the bracket relative to the top piece comprises threading a corresponding two nuts on the two threaded rods so as to raise the bracket towards the top piece, wherein further threading of the corresponding two nuts on the two threaded rods brings the protruding portion of each arm into contact with the slab, wherein further threading of the corresponding two nuts on the two threaded rod issues the slab, wherein such threading is continued until the slab reaches the desired position.

15. The method according to claim 1, wherein the bracket comprises a plurality of sections which are connected together after insertion of the plurality of sections into the excavated region.

16. The method according to claim 1, wherein introducing a material which hardens into the excavated area comprises substantially completely filling the excavated region with the material so as to substantially completely envelope the bracket with the material.

17. The method according to claim 1, wherein raising the bracket relative to the top piece comprises threading a corresponding at least one nut on each of the at least one threaded rod so as to raise the bracket towards the top piece, wherein further threading of the nut on each of the at least one threaded rod brings the protruding portion of each arm into contact with the slab, wherein further threading of the nut on each of the at least one threaded rod raises the slab, wherein such threading is continued until the slab reaches a desired position.

18. The method according to claim 1, wherein the tubing comprises a first section and a second section wherein the at least one threaded rod is fixedly attached to the second section of the tubing.

19. A bracket for lifting and stabilizing a slab, comprising:

a tubing which can slidably receive an end of a section of pier column;

at least one threaded rod and corresponding at least one nut, wherein the at least one threaded rod is fixedly positioned relative to the tubing such that a threaded portion of the at least one threaded rod extends above a top end of the tubing;

at least one arm fixedly positioned relative to the tubing such that a first section of each arm is fixedly attached to the tubing and a second section of each arm protrudes from the tubing for supporting a slab;

a corresponding at least one brace piece having a first end fixedly attached to the protruding portion of the arm and a second end fixedly attached proximate to a position on the tubing lower than the protruding portion of the arm so as to provide vertical support of the arm; and a top piece, wherein the bracket can be positioned over a base pier column under the subsided slab with a top section of pier column supported by the base pier column and positioned within the tubing with a top of the top section of pier column extending above the tubing, wherein the top piece can be placed over the top of the top section of pier column with the at least one threaded rod extending above the top piece such that threading the nut onto the threaded rod can hold the position of the threaded rod relative to the top piece, wherein the at least one nut can be attached to the corresponding at least one threaded rod above the top piece and tightened to raise the bracket thus lifting the slab.

20. The bracket, according to claim 19, wherein the cross-sectional shape of the tubing is a hollow cylinder.

21. The bracket according to claim 19, wherein the cross-sectional shape of the tubing comprises a hollowed shape which allows the insertion of the top section of pier column through the top end of the tubing of the bracket and coupling of the top section of pier column to the base pier column and prevents disengagement of the bracket from the base pier column when horizontal or rotational forces are applied to the tubing with respect to the top section of pier column inserted therethrough.

22. The bracket, according to claim 19, wherein the at least one arm and brace piece are formed as an integral piece.

23. The bracket, according to claim 19, wherein the bracket comprises a plurality of sections which can be connected together to form the bracket, wherein the plurality of section can be inserted through a smaller opening in a slab than the bracket.

24. The angle, according to claim 23, wherein the first and second sections of the at least one arm form an approximately 90 degree angle.

25. The bracket according to claim 19, wherein the brace piece is attached to the at least one arm near a proximal end of the at least one arm.

26. The bracket according to claim 19, wherein the arm and the brace piece form a three-dimensional shape selected from the group consisting of: a rectangle, a square and a triangle.

27. The bracket according to claim 19, wherein the bracket comprises two arms and corresponding brace pieces positioned on opposite sides of the tubing.

28. The bracket according to claim 27, wherein the bracket can be inserted through an opening in the slab large enough to allow insertion of the bracket through the opening and small enough such that, after insertion through the opening in the slab, the bracket can be positioned such that the distal end of each of the two arms are brought into contact with a bottom surface of the slab to support the slab.

29. The bracket, according to claim 19, further comprising at least one reinforcement member, wherein where a material which hardens envelopes the bracket and hardens to form a plug, the at least one reinforcement member reinforces the plug.

30. The bracket, according to claim 19, wherein the brace piece is modified such that the brace piece maybe attached to the bracket with an attachment means selected from the group and welding consisting of: a nut and bolt assembly, rivets, screws.

31. The bracket, according to claims 19, wherein the first end of the brace piece is welded to the proximal end of the protruding section of the arm and the second end of the brace piece is welded to a point proximate to a position on the tubing lower than the protruding portion of the angle.

32. The bracket according to claim 19 wherein at least two threaded rods are fixedly positioned on opposite sides of the bracket, with at least a portion of the threads on the threaded rods extending above the top end of the tubing of the bracket.

* * * * *

UNITED STATES PATENT AND TRADEMARK OFFICE

CERTIFICATE OF CORRECTION

PATENT NO. : 6,814,524 B1
DATED : November 9, 2004
INVENTOR(S) : James L. Peterson It is certified that error appears in the above-identified patent and that said Letters Patent is hereby corrected as shown below:

Column 3,
Line 28, “foxed” should read -- formed --.

Column 7,
Line 5, “tubing 7” should read -- tubing 1 --.

Column 8,
Line 41, “over the lop” should read -- over the top --.

Column 9,
Line 58, “issues the slab” should read -- raises the slab --.

Column 12,
Line 9, “group and welding consisting of: a nut” should read -- group consisting of: a nut and bolt assembly, rivets, screws, and welding --.

Signed and Sealed this

Twenty-seventh Day of September, 2005

JON W. DUDAS
*Director of the United States Patent and Trademark Office*